US006068044A

United States Patent [19]

Fahl

[11] Patent Number: 6,068,044

[45] Date of Patent: May 30, 2000

[54] FLUID COUPLING WITH LOCKED SLEEVE

[75] Inventor: Richard L. Fahl, Fairfield, Ohio

[73] Assignee: Delaware Capital Formation, Inc., Wilmington, Del.

[21] Appl. No.: 08/957,636

[22] Filed: Oct. 24, 1997

[51] Int. Cl.[7] ..... B22D 19/12

[52] U.S. Cl. ..... 164/98; 137/614.06; 251/148

[58] Field of Search ..... 164/98, 99, 100, 164/101, 102, 103; 137/614.06; 251/148

[56] References Cited

U.S. PATENT DOCUMENTS

| | | | |
|---|---|---|---|
| 2,696,993 | 12/1954 | Buckler | 137/614.04 |
| 4,458,924 | 7/1984 | Schlicht | 164/99 |
| 5,000,492 | 3/1991 | Kemp | 285/363 |
| 5,407,175 | 4/1995 | Roberts et al. . | |

FOREIGN PATENT DOCUMENTS

| | | | |
|---|---|---|---|
| 1234165 | 6/1971 | United Kingdom | 164/98 |

*Primary Examiner*—Kuang Y. Lin
*Attorney, Agent, or Firm*—Dinsmore & Shohl LLP

[57] ABSTRACT

A method of making a coupling assembly for use in a loading adapter of a gasoline tanker trailer. The coupling includes an aluminum coupling body and a wear resistant bronze sleeve. The wear resistant bronze sleeve provides a durable surface for receiving latches. The sleeve does not bond to the coupling body, but rather is constrained thereto by physical interference.

3 Claims, 4 Drawing Sheets

FLUID COUPLING WITH LOCKED SLEEVE

TECHNICAL FIELD

The present invention relates to objects cast to have a wear resistant portion and to a method for casting objects which have a wear resistant portion. The invention will be specifically disclosed in connection with a fluid coupling assembly having a wear resistant ring placed around a coupling body, so that the ring forms a part of the mold used to cast the coupling body, and so that the geometry of the coupling body serves to constrain movement of the ring relative to the coupling body after casting. The preferred form of the invention relates to a coupling assembly for a gasoline tanker trailer loading adapter having a wear resistant bronze ring cast around an aluminum coupling body.

BACKGROUND OF THE INVENTION

In commerce, there is often a need to transfer a large quantity of liquid from a first vessel to a second vessel. Conventionally, a hose runs from the first vessel to a rigid coupling termination, and another hose runs from the second vessel to a rigid coupling termination. The coupling of the first hose is connected to the coupling of the second hose, and then liquid is controlled (by valves, pumps and the like) to flow from the first vessel, through the connected hoses and into the second vessel. When dealing with a high rate and intermittent liquid flow, a lot of stress may be exerted on the connection between the couplings of the hoses. Therefore, the means for connecting the couplings must be designed to handle this large stress.

One example of this liquid transfer situation is the loading of gasoline between a storage a tank on a tanker trailer. A hose runs from a gasoline tank to a rigid tank-side coupling having opposing latches. Another hose runs from the tanker trailer to a rigid trailer-side coupling having a surface to receive the latches. When the two couplings are connected the opposing latches of the tank-side coupling tightly clamp the receiving surface of the trailer-side coupling to effect a strong connection between the hoses. With this strong connection, a large and intermittent volumetric flow of gasoline will not compromise the connection between the hoses, and the transfer of gasoline between the tank and tanker trailer can be quickly accomplished.

Some conventional embodiments of this kind of tank and trailer couplings are disclosed in U.S. Pat. No. 5,407,175 to Roberts et al., which is herein incorporated by reference. More specifically, Roberts et al. disclose a removable fluid coupling (i.e., a tank-side coupling) which can latch an annular surface of a flow valve (i.e., a trailer-side coupling).

Roberts et al. recognize that the latches of the fluid coupling cause wear on the annular receiving surface of the flow valve. The flow valve embodiments of Roberts et al. are constructed so that the annular receiving surface is located on a detachably attachable annular flange which fits around the body of the flow valve and can be secured thereto at various angular orientations. When the latches begin to cause sufficient wear at portions of the annular flange, the annular flange is removed and repositioned to a different angular orientation so that different, unworn portions of the annular flange receive the latches. Because the annular flange can be repositioned to be worn down at several positions, the life of the annular flange part is extended.

Of course, manual labor is required to periodically monitor and reposition the annular flange. Also, the means for detachably attaching the annular ring to the body of the flow valve must be provided at some cost. For instance, tapped holes and/or set screws, and further, this means for detachably attaching may be subject to mechanical failure.

In another conventional design for a trailer-side coupling, an annular receiving surface is made integrally with the body of an aluminum trailer-side coupling. The portion of the trailer-side coupling with the receiving surface is then treated to harden and provide additional wear resistance on the annular receiving surface. After treatment, the surfaces of the treated portions become rough, so the coupling is then remachined to smooth certain surfaces, such as the poppet valve seat. By this treatment, the latches of the tank-side coupling will cause less wear, thereby considerably extending the life of the trailer-side coupling.

However, the treatment and remachining are expensive processes and increase the amount of material required to make the coupling. Also, the fact that the treated products must be remachined after treatment can cause logistical and scheduling problems.

DISCLOSURE OF THE INVENTION

It is an object of the present invention to provide an apparatus and process which obviates the above-described problems and shortcomings.

Another object of this invention is to provide a pipe assemblies, and other objects, which include two pieces which are fixed, stationary and in contact with each other without being bonded or attached by any separate attachment means.

It is a further object of the present invention to provide a method of casting to make an assembly including a first object and a second object, so that the second object forms a part of the casting mold for casting the first object, and so that the first object does not bond to the second object, but rather is held in place by physical interference between the first and second objects.

It is a further object of this invention to provide a coupling assembly including a coupling body and a wear resistant sleeve of two different materials, where the sleeve is fixed and in contact with the pipe, without being bonded to the coupling body or attached by any separate attachment means.

It is a further object of this invention to provide a one-piece trailer-side coupling (or loading adapter) for a gasoline tanker trailer which has an aluminum body with an annular bronze ring to provide a wear resistant annular receiving surface for receiving latches.

According to the present invention, an assembly includes two solid, homogeneous objects. As used herein, homogeneous is defmed to include objects which are homogeneous at the molecular level, as well as objects made of homogeneous mixtures (e.g., alloys, fiberglass, particle board). The first object has a first interface surface, and the second object has a second interface surface.

The first and second interface surfaces are in contact with each other, but not bonded to each other. The contacting first and second interface surfaces are shaped and oriented so that the objects will not come apart due to constraint of substantial relative movement between the two objects in some directions, or in all directions. The constraint is due to physical interference between the interface surfaces.

For example, the first object may be substantially in the shape of a cylinder with the second object being a ring fitting around the annular surface of the cylinder, wherein physical interference between the first and second interface surfaces prevent longitudinal and radial movement of the ring, while allowing angular movement (i.e., rotation of the ring about the central axis of the cylinder).

In one aspect of the present invention, a coupling assembly includes a coupling body and a sleeve. As used herein, the coupling body defines a conduit suitable for transferring liquid therethrough, including, but not limited to tubular conduits of substantially circular cross-section.

The coupling defmes a longitudinal direction, a radial direction and an angular direction. The coupling has a sleeve interface surface. The sleeve has a coupling interface surface in contact with, but not bonded to, the pipe interface surface.

The coupling interface surface and sleeve interface surface are shaped to prevent any substantial relative motion between the pipe and the sleeve in the longitudinal direction. The shaping of the pipe and sleeve interface surface to prevent relative longitudinal motion can be accomplished in many ways. For example, a backdraft or protuberances in the surfaces can prevent longitudinal movement.

In some embodiments of the present invention, the sleeve will be free to move in the angular direction. This can provide stress relief in the pipe assembly in the angular direction, while maintaining longitudinal and radial constraint of the coupling assembly, and thereby preventing the sleeve and coupling body from coming apart. In other embodiments, the sleeve interface surface and coupling interface surface are shaped to prevent angular movement as well as longitudinal movement. Again, this can be accomplished by appropriate backdrafts and/or protuberances in the interface surfaces.

In some preferred embodiments of the present invention, the coupling is made of aluminum, which is relatively cheap and easy to work with, while the sleeve is made of relatively wear resistant bronze. Even though aluminum does not bond chemically to bronze, the geometry of the present invention will keep the bronze sleeve and the aluminum pipe together without the need to resort to adhesive, solder or the like. This teaching is also applicable to other combinations of metals and other combinations of materials generally.

In some preferred embodiments of the present invention, a gasoline line coupling assembly, for use in a loading adapter which interfaces with a tank loader, includes a coupling body and a sleeve. The coupling body is made of a first metal having a first melting point. The coupling body defines a longitudinal direction, a radial direction and an angular direction. The coupling body has an outer surface including a sleeve interface surface. The sleeve is made of a second metal having a second melting point which is lower than the first melting point. It is noted that because the melting point of the sleeve is lower than the melting point of the pipe end, it will often be possible to cast the sleeve in place, directly onto the coupling.

The sleeve has an inner surface including a coupling interface surface. The coupling interface surface is in contact with, but not bonded to, the sleeve interface surface. The sleeve interface surface extends 360° in the angular direction, thereby preventing relative motion in the radial direction. The coupling interface surface and sleeve interface surfaces are shaped to prevent any substantial relative motion between the pipe and the sleeve in the longitudinal direction, as well.

According to another aspect of the present invention, a method of making a coupling assembly includes a step of providing a sleeve made of a first material having a first melting point, with the sleeve having a coupling interface surface. The method further includes a step of providing a cast in proximity to, but spaced apart from, the coupling interface surface, with the cast being shaped to form a coupling of a predetermined shape defmed by the cast and the coupling interface surface. The method further includes the step of selecting a second material to form the coupling so that the second material has a lower melting point than the first material and so that the second material will not bond to the first material when the second material cools from a molten to a solid state in contact with the first material. The method further includes the step of providing the second material in a molten state between the cast and the coupling interface surface. The method further includes the step of cooling the second material from the molten state to form a coupling in a solid state. The method further includes the step of removing the cast to yield the coupling assembly.

In some preferred embodiments of the present invention, the coupling body is made of aluminum and the sleeve is made of cast bronze.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE PREFERRED EMBODIMENT

Figure 1:
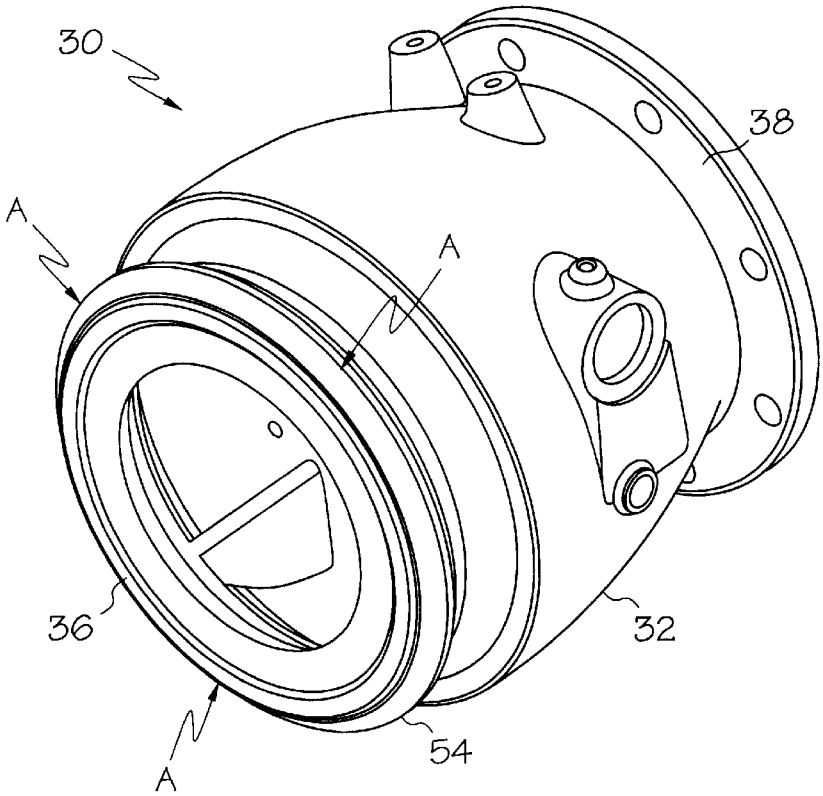
FIG. 1 is a perspective view of a trailer-side coupling.

Conventionally, when two objects of dissimilar materials need to be permanently assembled, the objects are glued together by an adhesive, or chemically bonded directly to each other (e.g., thermal lamination), or attached by separate attachment means like nails or screws. According to the present invention, two objects are attached by forming one of the objects so that its geometry locks it to the other object by physical interference, without the need to bond the objects (directly or by adhesive) or to resort to separate attachment means.

The assemblies of the present invention can be especially useful when the two objects are made of materials which will not readily form a direct bond, so that adhesive or other attachment means would be required but for the locking geometry assembly provided by the present invention.

While some limited motion between the two objects of the assembly may be permitted by the locking geometry of the present invention, the locking by physical interference must be sufficient to prevent the two objects from coming apart. For example, assume that a nail is driven into a wood board. While physical interference between the nail and the board does constrain relative motion in some directions, the nail will come apart from the board because it is free to be pulled out in the direction of its longitudinal axis. Likewise, a screw which has been screwed into a board will come apart from the board because the physical interference between the board and screw still allows the screw to be unscrewed.

In some embodiments of the present invention, a wear resistant bronze ring can be press fit, friction fit or shrink-fitted onto a coupling body so that the sleeve and coupling body do not come apart during normal use.

However, in preferred embodiments of the present invention, the strength, elasticity and difference in the rates of thermal expansion of the two assembled objects are such that the objects cannot be assembled by press, friction or shrink fitting. This helps to ensure that there is a strong connection between the objects and that they will not come apart during normal use due to mechanical strain or differential thermal expansion. This preferred kind of permanent attachment between the objects will be a function of both the locking geometry and the materials properties (i.e., elasticity and strength) of the present materials, and the intended use environment of the assembly.

The present invention preferably utilizes a casting method, wherein a first metal object is provided, and a second metal object is cast in place around a portion of the first object using a mold. The second object is shaped so that the two objects are constrained (at least with respect to some directions of motion) to each other by physical interference, despite the fact that the two objects are selected to be made of two metals which do not bond to each other. The two metals are preferably selected with the metal of the first object having a higher melting point than the metal of the second object so that the first object does not melt too much while the second object is being cast in place around it.

Although, the present invention has been described above in general terms, some especially useful embodiments of the present invention involve assemblies of two different types of metals for gasoline line couplings. Several embodiments of trailer-side fluid coupling assemblies for a gasoline line will now be described in detail with reference to the drawings, wherein like numerals indicate the same elements throughout the views, and wherein elements having the same final two digits (i.e., 54, 154, 254) indicate comparable elements of various preferred embodiments.

An especially preferred embodiment of a trailer-side gasoline line coupling will now be discussed with reference to FIGS. 1 through 5 and 7 through 9. As shown in FIG. 1, the exterior portion of the coupling 30 is mainly constituted by a one-piece aluminum coupling body 32. Alternatively, the coupling body may be made of two or more pieces fastened together by screws or the like.

Figure 2:
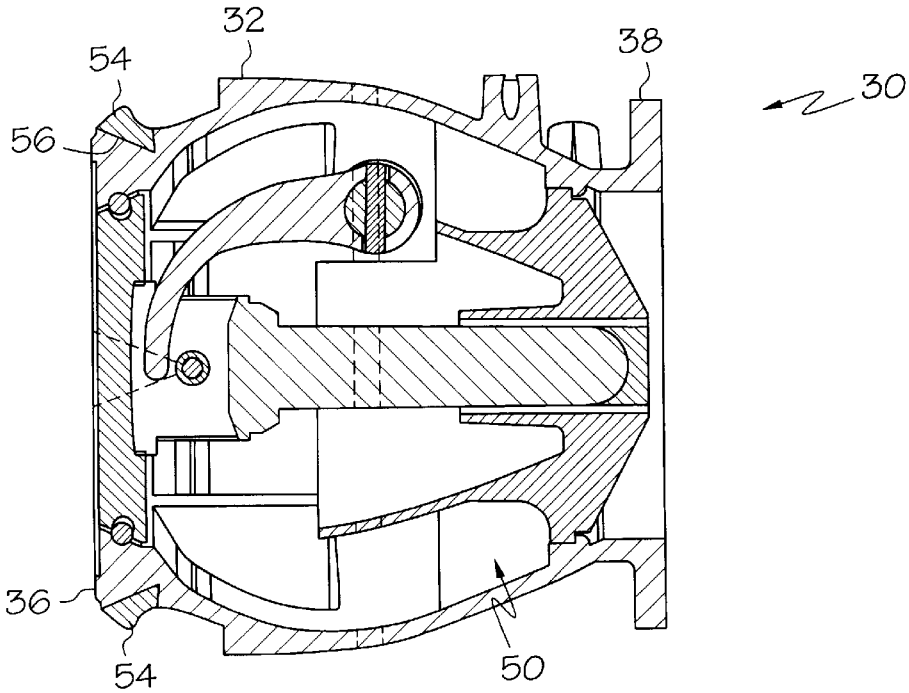
FIG. 2 is a sectional view of the trailer-side coupling shown in FIG. 1.

At one end of the coupling body 32 is a flange 38 for conventional attachment to a gasoline trailer tank (not shown). At the other end of the coupling body 32 is coupling end 36. A tank-side coupling (not shown) is detachably attachable at coupling end 36. When the tank-side coupling is coupled at the coupling end 36, gasoline can be transferred between tanks through hoses connected by the couplings. As shown in FIG. 2, conventional internal components 50 control the flow of gasoline through coupling 30.

Figure 4:
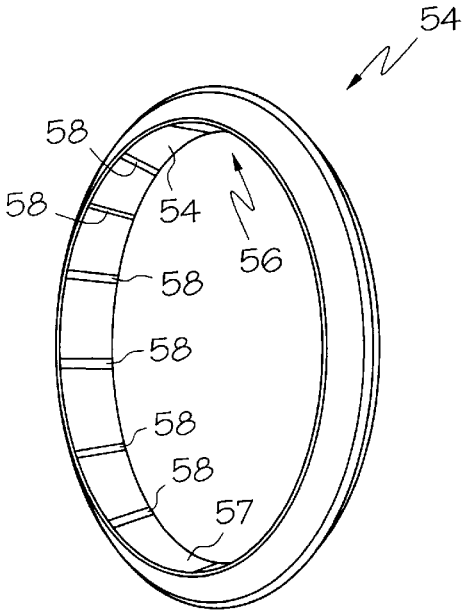
FIG. 4 is a perspective view of an embodiment of the sleeve.

As shown in FIGS. 1 and 4, a wear resistant bronze sleeve 54 is disposed around coupling end 36. Alternatively, the sleeve could be made of other wear resistant materials, such as brass or zinc aluminum. Conventional latches (not shown) of the tank-side coupling (not shown) are received on the exterior surface of the sleeve 54 in locations shown by arrows A to effect connection of the tank-side coupling to the trailer-side coupling 30. More particularly, the latches are received by the latch interface surface 55 (see FIG. 5) of sleeve 54.

Because the connection between coupling must be strong and reliable, the latches exert a great amount of force on sleeve 54. However, the wear resistant bronze of sleeve 54 is relatively durable and allows the coupling 30 to have a long service life before the coupling 30 needs to be replaced due to wear caused by the latches. It is also noted that although the sleeve 54 is made of bronze, the coupling body 32 is made of aluminum, which is light in weight, relatively inexpensive, and relatively easy to form into the shape of a coupling body.

Of course, the sleeve 54 must be connected to the coupling body 32. Furthermore, this connection must be strong because of the forces exerted by the latches, the flow of gasoline through the couplings and other mechanical shocks (e.g., rocks or debris encountered on a highway). According to the present invention, the sleeve 54 is permanently fixed to the coupling body 32 by physical interference between the sleeve 54 and the coupling body 32. No separate attachment means are required.

Preferably, the coupling body 32 is cast in place relative to the bronze sleeve 54, so that when the coupling body 32 cools and solidifies, it is prevented from moving relative to the sleeve 54 (at least in certain directions) by physical interference with the sleeve 54 itself.

It is also noted that when the coupling body 32 is cast in place within the sleeve 54, the exterior surfaces of the coupling end 36 and the sleeve 54 may be smoothed by machining as a single solid body, which facilitates the machining. Also, a rough cast bronze sleeve may be used when casting the coupling body in place. The cast assembly is then machined as a single piece. This obviates the need to provide smooth interface surfaces on the sleeve and/or coupling body to ensure that these pieces fit together. Because the coupling body is cast inside of the sleeve, the coupling body will fit and conform to even a cast sleeve having rough interface surfaces.

Figure 3:
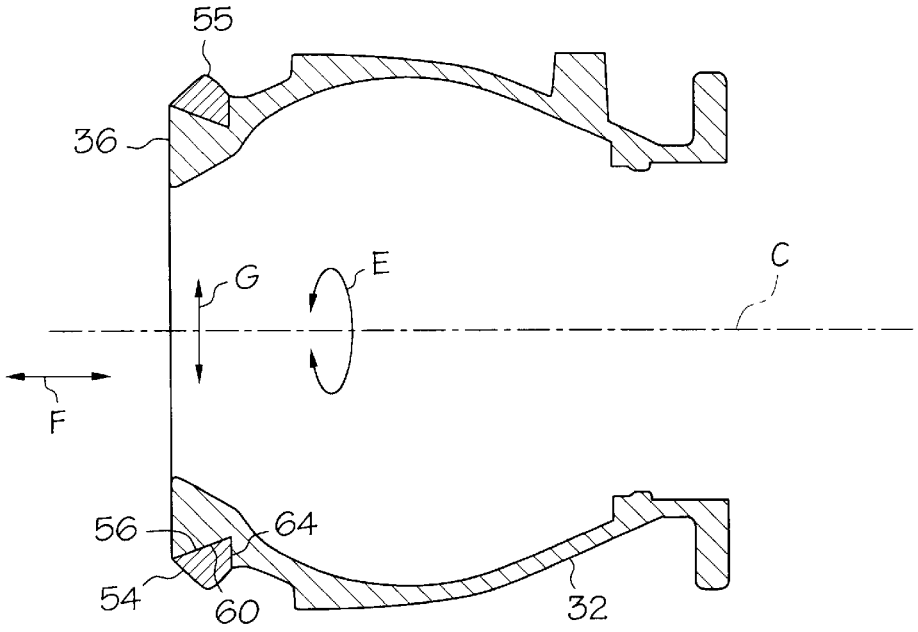
FIG. 3 is a sectional view of an assembly including the coupling body and sleeve shown in FIG. 2.
Figure 8:
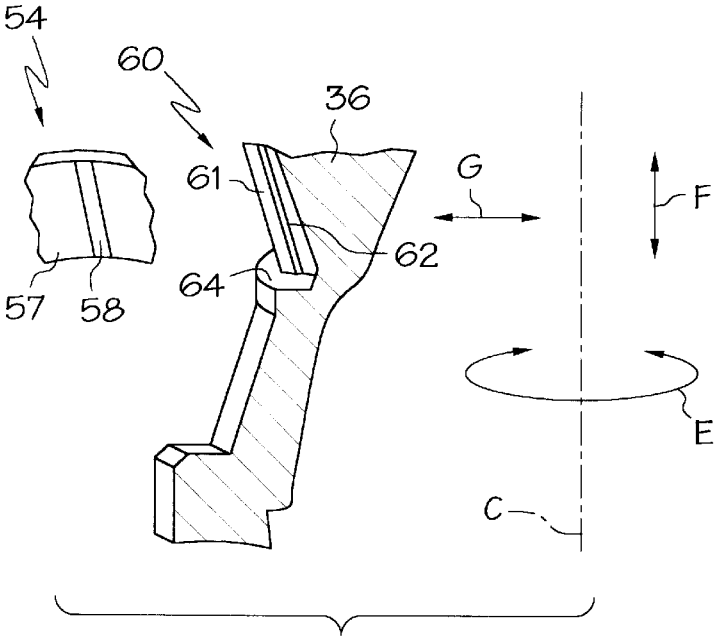
FIG. 8 is an exploded sectional view of a portion of an assembly including the sleeve shown in FIG. 4 and a coupling body.
Figure 9:
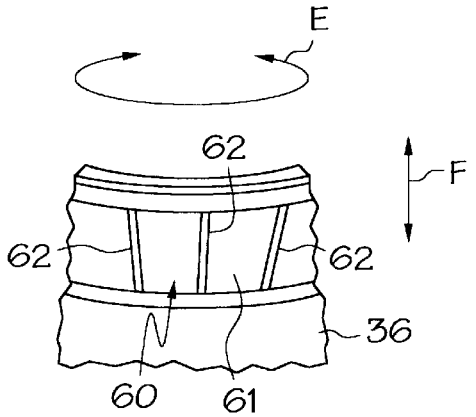
FIG. 9 is a view of a portion of the coupling body shown in FIG. 8.

Referring now to FIG. 3, a coupling interface surface 56 of the sleeve 54 is disposed adjacent to a sleeve interface surface 60 of the coupling end 36. As shown in FIGS. 8 and 9, the sleeve interface surface 60 of the coupling end 36 has protruding ridges 62 and flat portions 61 between the ridges 62. As shown in FIGS. 4 and 8, the coupling interface surface 56 of the sleeve 54 has corresponding grooves 58 and flat portions 57 between the grooves. Each ridge 62 fits into a groove 58.

Figure 7:
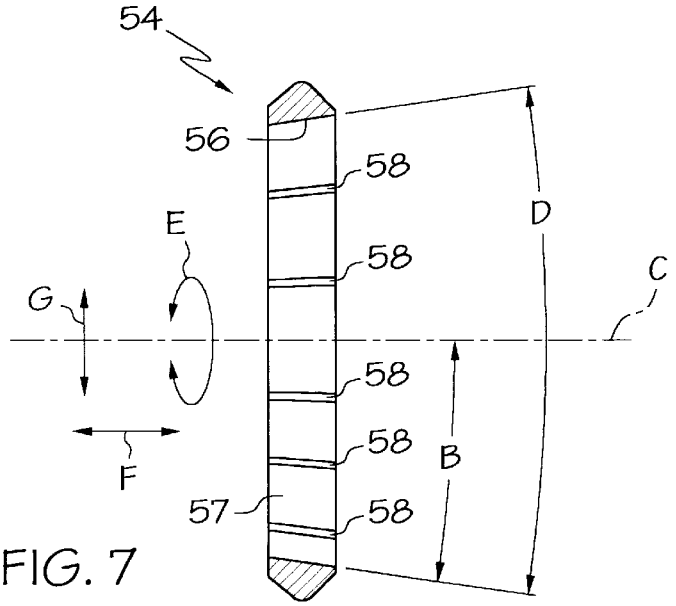
FIG. 7 is a sectional view of the sleeve shown in FIGS. 4 and 5.

As shown in FIGS. 3 and 7, the sleeve interface surface 60 and the coupling interface surface 56 are not parallel to the central axis C of the coupling 32 and the sleeve 54. Rather the sleeve interface surface 60 and the coupling interface surface 54 are formed with a backdraft so that there is an angle between these surfaces and the central axis C. As shown in FIG. 7, there is an angle B between the coupling interface surface 56 and the central axis C. Preferably, angle B should be between 5 and 20°. The angle between two opposite portions of the coupling interface surface 56 is shown by the angle D.

As shown in FIGS. 3 and 8, the coupling end 36 also has a sleeve seat 64 which is disposed adjacent to the sleeve 54.

The locking geometry of the sleeve 54 and the coupling end 36, which includes the backdrafted interface surfaces having corresponding ridges 62 and grooves 58 and the sleeve seat 64 will prevent substantial relative motion between the sleeve 54 and the coupling body in any direction.

More particularly, as shown in FIG. 3, three directions E, F, G of motion can be defined with reference to the central axis C. Direction E is the direction of angular motion around the central axis C. Direction F is the direction of longitudinal motion along the central axis C. Direction G is the direction of radial motion in the directions away from and toward the central axis C.

Relative motion in the radial direction G is prevented by the fact that the sleeve 54 fits around the coupling end 36. Relative motion in the longitudinal direction F is prevented by the angled backdraft and opposing sleeve seat 64. Relative motion in the angular direction E is prevented by the ridges 62 and grooves 58. These physical interferences, designed into the geometries of the parts themselves, therefore prevent relative motion in any direction between the coupling end 36 and the sleeve 54. No additional connection means or adhesives are required, there are only two solid, yet locked, parts.

The preferred method of forming this assembly between the coupling end 36 and the sleeve 54 is by casting the coupling end 36 within the sleeve 54. In this method, a sleeve 54 is provided, and placed in a mold (not shown). Portions of the mold are spaced away from the sleeve 54 in the vicinity of the coupling interface surface 56. These spaced away portions of the mold will define the interior surfaces of the coupling end 36 as it solidifies. The sleeve 54 is formed with the backdraft and grooves 58, as described above.

Molten aluminum is then poured into the mold and solidified, so that the coupling end 36 is formed in the space between the sleeve 54 and the mold. Because bronze has a higher melting point than aluminum, the molten aluminum will not melt the bronze sleeve 54 to any large extent. If different metals are used for the sleeve 54 and/or coupling end 36, then the part with the higher melting point should generally be used as part of the mold, and the lower melting point metal then should be cast in around it.

The molten aluminum is allowed to cool and solidify in the shape of the coupling end, including the backdraft and ridges 62 which are defined by the coupling interface surface 56 of the sleeve 54. After the molten aluminum sufficiently solidifies into coupling end 36, the mold is removed.

It is noted that the physical interferences designed into the geometries of the parts themselves allow this casting to permanently constrain the sleeve 54 to the coupling end 36 despite the fact that aluminum and bronze do not bond to a significant degree when aluminum is cast adjacent to bronze. Accordingly, the physical interferences of the present invention can be used to connect two solid parts of two metals (or other materials) which do not bond to each other.

Although casting is the preferred method of forming the assembly, other methods can be used. For example, the sleeve 54 could be provided in two or more segments, which could then be placed about the coupling end 36 and spot welded together to form a single-piece sleeve 54 which is constrained to the coupling end by the physical interferences described above. Other assembly methods such as shrink fitting or press fitting may be possible, although these methods may be difficult or cost-prohibitive due to the dimensions of the sleeve, coupling end and backdraft angle, and due to the fact that bronze and aluminum are preferred materials.

Figure 6:
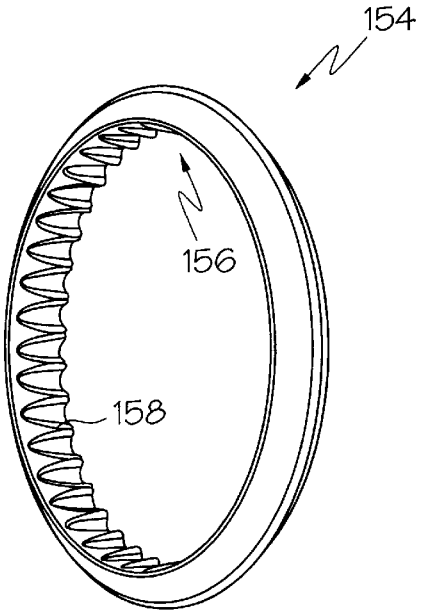
FIG. 6 is a perspective view of another embodiment of the sleeve.
Figure 5:
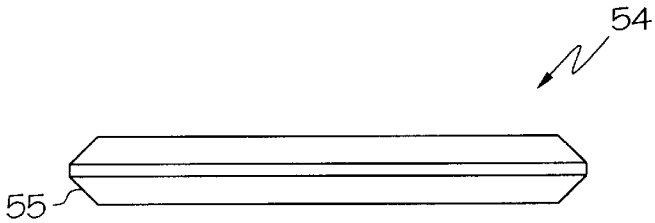
FIG. 5 is a side view of the sleeve shown in FIG. 4.

Although the embodiment described above employed corresponding ridges 62 and grooves 58 to prevent angular motion between the sleeve 54 and coupling end 36, other surface patterns at the sleeve-coupling interface surfaces are also effective. For example, a sleeve 154, shown in FIG. 6, has protruding arches 158 on its coupling interface surface 156. The protruding arches 158 would fit into corresponding depressions in the sleeve interface surface of a coupling end (not shown).

Figure 10:
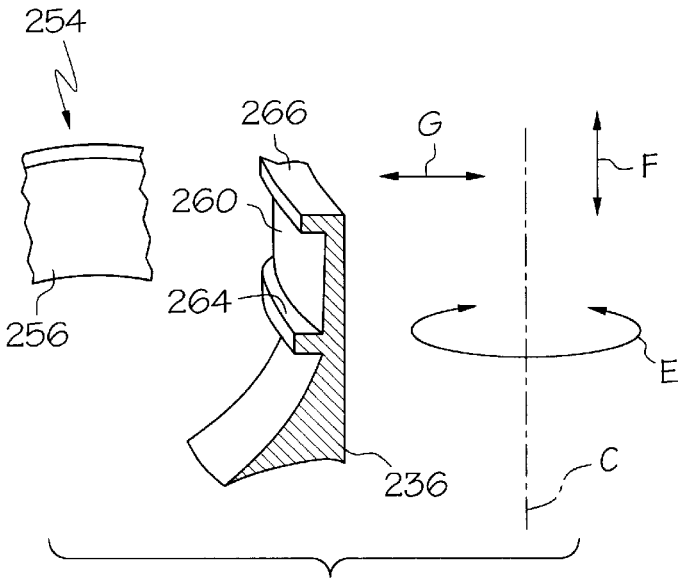
FIG. 10 is an exploded sectional view of a portion of an assembly including a coupling body and a sleeve.

Another embodiment of a sleeve and coupling end interface is shown in FIG. 10. In this embodiment, a sleeve 254 is disposed around coupling end 236. Because the sleeve 254 is disposed around the coupling end 236, physical interference will prevent relative radial motion in the direction G. Physical interference between the sleeve 254 and the upper sleeve seat 266 and the lower sleeve seat 264 will prevent relative longitudinal motion in the direction F. Note that upper sleeve seat 266 performs a similar function to the backdraft in the embodiment of FIGS. 3 and 7.

The coupling interface surface 256 of the sleeve 254 is flat, as is the sleeve interface surface 260 of the coupling end 236. These flat surfaces do not prevent relative angular motion in the direction E. Therefore, the sleeve 254 is free to rotate about the coupling end 236. In some applications, this freedom to rotate may help provides stress relief from twisting forces, or it may help distribute wear on the latch receiving surface of the sleeve.

As stated above, physical interference constrains the sleeve 254 to the coupling end 236 only in the directions F and G. It is noted that the physical interference is sufficient to prevent the sleeve 254 from being removed from the coupling end 236. This is not to suggest that constraint in two directions provided by physical interference will always prevent the pieces from coming apart. While no simple general rules are proposed for determining a priori whether physical interference will prevent two parts from coming apart, it is easy to determine for a given proposed geometry whether the parts can be separated without breaking or deforming one or both of the parts.

Figure 11:
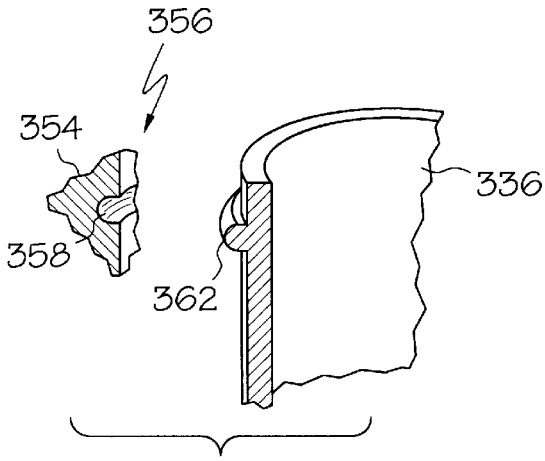
FIG. 11 is an exploded sectional view of a portion of an assembly including a coupling body and a sleeve.

FIG. 11 shows another assembly of a sleeve 354 and a coupling end 336. The coupling end 336 has an annular ridge 362 which fits into an annular groove 358 in the coupling interface surface 356 of the sleeve 354.

Figure 12:
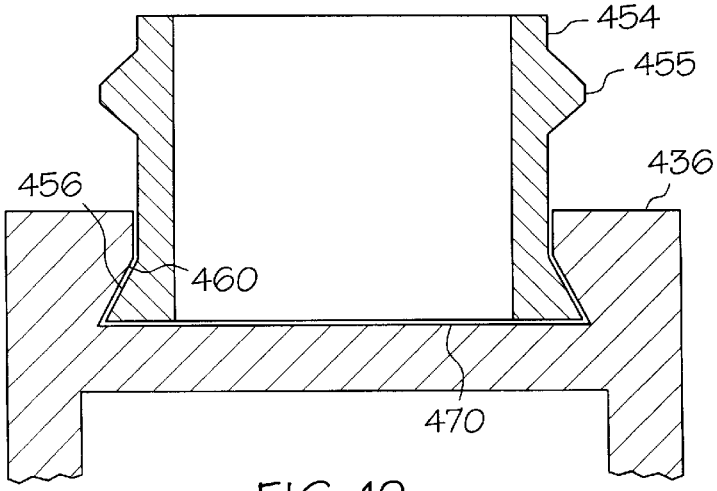
FIG. 12 is an exploded sectional view of a portion of an assembly including a coupling body and a sleeve.

FIG. 12 shows another embodiment of an assembly of a sleeve 454 and a coupling end 436. In this embodiment, the sleeve 454 is placed inside of the coupling end 436. A portion of the sleeve 454 including latch receiving surface 455 protrudes from the end of the coupling end 436. Coupling interface surface 456 of sleeve 454 and sleeve interface surface 460 of coupling end 436 are formed with an angled backdraft that opposes sleeve seat 470. By this geometry, the coupling end 436 and the sleeve 454 are prevented from coming apart by physical interference, despite the fact that the two parts are not chemically bonded, adhered by adhesive, or connected by separate attachment means.

While the present invention has been explained with reference to trailer-side couplings, the invention also applies more broadly to fluid couplings in general, and may even be applied to other kinds of assemblies.

Having shown and described the preferred embodiments of the present invention, apparatus described herein can be accomplished by appropriate modifications by one of ordinary skill in the art without departing from the scope of the present invention. A number of such alternatives and modifications have been described herein, and others will be apparent to those skilled in the art. Accordingly, the scope of the present invention should be considered in terms of the following claims, and is understood not to be limited to the details of the structures and embodiments shown and described in the specification and drawings.

What is claimed is:

1. A method of making a coupling assembly comprising the steps of:

providing a sleeve made of a first maternal having a first melting point, with the sleeve having a coupling interface surface;

providing a mold in proximity to, but spaced apart from, the coupling interface surface, with the mold being shaped to form a coupling of a predetermined shape defined by the mold and the coupling interface surface;

selecting a second material to form the coupling so that the second material has a lower melting point than the first material and so that the second material will not bond to the first material when the second material cools from a molten to a solid state in contact with the first material;

providing the second material in a molten state between the mold and the coupling interface surface;

cooling the second material from the molten state to form a coupling in a solid state; and after the step of cooling the second material, removing the mold to yield the coupling assembly.

2. The method of claim 1, wherein the first material has a greater wear resistance than the second material.

3. The method according to claim 1, wherein the first material is bronze and the second material is aluminum.

* * * * *